US007246447B2

(12) United States Patent
Demko

(10) Patent No.: US 7,246,447 B2
(45) Date of Patent: Jul. 24, 2007

(54) APPARATUS AND METHOD FOR FORMING DESIGNS IN A HAIRED SURFACE

(76) Inventor: Alexis Sydney Demko, 419 S. Marshall Ave., El Cajon, CA (US) 92020

( * ) Notice: Subject to any disclaimer, the term of this patent is extended or adjusted under 35 U.S.C. 154(b) by 0 days.

(21) Appl. No.: 11/083,692

(22) Filed: Mar. 17, 2005

(65) Prior Publication Data

US 2005/0205105 A1 Sep. 22, 2005

Related U.S. Application Data

(60) Provisional application No. 60/554,244, filed on Mar. 17, 2004.

(51) Int. Cl.
*A45D 24/36* (2006.01)

(52) U.S. Cl. ..... 33/512; 132/214

(58) Field of Classification Search ..... 33/562, 33/512; 132/213, 213.1, 214, 319, 333; 30/51, 30/526, 531; 119/600, 607; 606/116, 117; 16/422

See application file for complete search history.

(56) References Cited

U.S. PATENT DOCUMENTS 1,962,357 A * 6/1934 Nessler ..... 33/512
1,962,518 A * 6/1934 Nessler ..... 33/512
2,033,139 A * 3/1936 Jefferis ..... 132/319
3,274,683 A * 9/1966 Sachs ..... 30/51
3,277,902 A * 10/1966 Korst ..... 132/150
3,433,232 A * 3/1969 Garrett ..... 132/208
3,858,589 A * 1/1975 Geiger ..... 132/214
4,977,672 A * 12/1990 Hamilton ..... 30/233
5,329,946 A * 7/1994 Guma ..... 132/213.1
5,349,971 A * 9/1994 Player ..... 132/213.1
6,026,577 A * 2/2000 Ferraro ..... 30/526
6,237,232 B1 * 5/2001 Petricca et al. ..... 30/526
2004/0255971 A1 * 12/2004 Houghton ..... 132/319
2005/0000536 A1 * 1/2005 Notorio ..... 132/213

FOREIGN PATENT DOCUMENTS

FR 2818508 A1 * 6/2002
WO WO 9108663 A1 * 6/1991

* cited by examiner

*Primary Examiner*—R. Alexander Smith
(74) *Attorney, Agent, or Firm*—Donn K. Harms

(57) ABSTRACT

A device and method for forming designs into the haired surface on the body. The device features a design head having a shape defined by a perimeter edge and a support shaft engaged with the design head. Hair is trimmed from the haired surface adjacent to the perimeter with one hand while the other hand compresses the design head against the haired surface. A second shape may be formed by trimming the haired surface inside of an aperture located inside the perimeter edge of the design head.

8 Claims, 1 Drawing Sheet

APPARATUS AND METHOD FOR FORMING DESIGNS IN A HAIRED SURFACE

This application claims priority from U.S. provisional application Ser. No. 60/554,244, filed Mar. 17, 2004.

BACKGROUND OF THE INVENTION

1. Field of the Invention

The present invention relates to the cutting of hair. More particularly the device and method herein disclosed relates to a method and apparatus to cut special designs into the scalp and other hair on a human or the fur on an animal body. The device employs a stencil or design head that is engaged at the distal end of a support shaft that provides a guide during removal of hair or fur. Employing the stencil component, special designs may be cut into the hair on the body of a person or animal leaving either a positive or negative design depending on whether hair is removed leaving skin surrounded by hair, or hair is protected and surrounding hair is removed. Employing a plurality of removably engageable stencil heads, the device enables the user to place an infinite number of designs on the hair or fur.

2. Prior Art

Hair cutting and hair removal on the body of humans is a common practice. The hair on the head is commonly styled to the style of the individual being given the haircut by a stylist. Also common is the removal of hair from other areas of the body including the arms and pubic hair. This can be done with a razor or wax or a chemical means of hair removal. Animals too have their fur cut using razors or other means for fur removal.

For the more artistic members of the culture the removal of surrounding hair in regions of hair growth on the body in order to leave a design in a positive or negative format can be a popular form of artistic expression. This can also be done in reverse by removing hair inside a surrounding surface of growing hair. However, such a removal of hair to leave a design is generally a subjective process with the eventual artistic outcome of the adventure directly dependant on the skill and artistic ability of the stylist or hygienist removing or cutting the hair in question. Much like a tattoo, removing hair from a human or fur from an animal in order to leave a design on the body can turn out badly if the stylist is less than talented.

In such an obviously subjective system of artistic hair removal there is a need for components that will allow for a more constant achievement of artistic results in the artistic endeavor of hair removal resulting in designs on the body. Such a device should be easily useable by both professional and marginally skilled hair stylists and hygienists while still yielding repeatable professional results. Such a device should allow for a large number of artistic designs to be placed in the hair or fur being removed with an ease of use that will allow for the procedure to be done in a timely yet accurate fashion. Such a device should allow the buyer to choose the exact design desired before it is placed on the scalp, skin, or a more indiscrete spot on the body.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Consequently, those skilled in the art will appreciate that the conception upon which this disclosure is based may readily be utilized as a basis for designing of other devices, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification, wherein detailed description is for the purpose of fully disclosing the invention without placing limitations thereon.

SUMMARY OF THE INVENTION

The device herein disclosed achieves accurate placement of an infinite number of designs in the hair on the body of the person or animal such as a dog or cat being groomed with a haircut or hair removal from some other portion of their anatomy. The device provides a design head having an exterior perimeter edge that is used as a guide for the hygienist or stylist to form a design such as a heart or star or flower on the head or other haired area of the client. The design can be easily duplicated or accompanied by another design through the simple engagement of a differently shaped design head for the clippers.

In one preferred embodiment, designs in the desired shapes are permanently engaged to the end of a support shaft such that the user may grip the support shaft at a distal end and place the attached design on the hair surface of a body being shaved or trimmed. In another preferred embodiment of the device, a plurality of differently shaped design heads are provided in kit form and engage with the support shaft using means to removably engage any of them individually to an attachment end on the support shaft, opposite the distal end of the support shaft.

Providing the design heads in kit form allows for compact storage of any number of shapes and sizes of the shapes for easy attachment and engagement on the user's head or other skin surface undergoing hair trimming or removal. Further, by employing interchangeable means for engagement of any of the design heads to the support shafts, new design heads can continually be sold and added to the kit to allow the user to enlarge the number of designs that can be placed into the hair or fur of the recipient in a professional repeatable fashion.

The design heads used to form the shapes in the haired surface of the individual may be positive in nature where they are outlined with clippers to leave longer hair in the shape of the design head. Or, the design head can have a hollow interior portion which would allow the user to either leave a negative impression on the hairy surface by shaving inside the perimeter of the hollow design head, or a positive impression adjacent to shorter hairs by shaving the haired surface around the perimeter of the design head. In another preferred embodiment, the design head can have an exterior perimeter defining one shape or design, and an interior perimeter of a void defining another shape. This would allow, for example, a circle using the interior perimeter to be placed inside of a star that is formed using the exterior perimeter.

An object of this invention is to provide a device that will allow for repeatable designs to be cut into the hair or fur on a human or animal.

Another object of this invention is to provide a device which will allow for an infinite number of different designs to be easily cut into hair or fur through the provision of removably engageable design heads.

An additional object of this invention is the provision of such a hair cutting component that will allow for a first design to be formed inside of a second exterior design in a repeatable fashion.

A still further object of this invention is the provision of such a hair cutting device for design formations in a kit form whereby new designs may be added to the kit collection of design heads as desired all being engageable to a support shaft.

An addition object of this invention is the provision of a method of cutting repeatable designs in hair or fur with the ability to change the design cut as desired.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

Figure 3A:
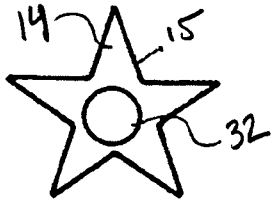

FIG. 3*a* depicts a top view of a design head having an exterior perimeter in one design shape and an interior perimeter defining a aperture of another design shape.

Figure 4:
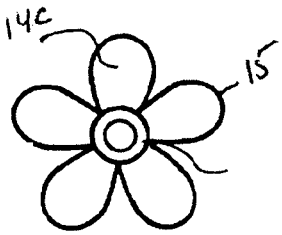

FIG. 4 is a top view of another design head shape in the form of a flower and showing a collar used to engage upon the support shaft.

Figure 5:
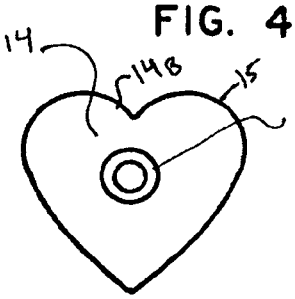

FIG. 5 is a top view of another design head shape in the form of a heart and showing a collar used to engage upon the support shaft.

Figure 6:
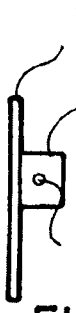

FIG. 6 is a side view showing the collar used as a means of removable engagement to the support shaft.

Figure 7:
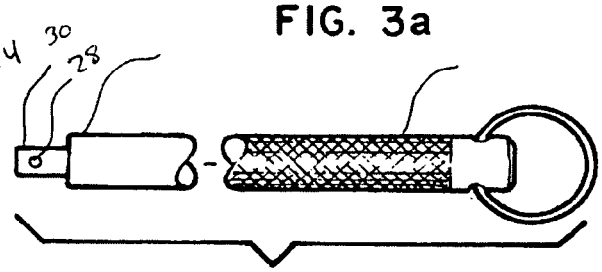

FIG. 7 is a side view of a support shaft adapted at one end for cooperative removable engagement to the design head.

DETAILED DESCRIPTION OF THE PREFERRED EMBODIMENTS OF THE INVENTION

Referring now to the drawings, FIGS. 1–7 depict the various embodiments and engagements of the herein disclosed device 10 and the method for cutting designs into the haired surface of an individual or the fur of an animal undergoing trimming or removal on their body. It should be noted that while the specification deals primarily with hair removal on the head or other parts of a human, the device may also be used on animals for the same purpose and such is anticipated.

The device 10 herein disclosed provides a major improvement in both the apparatus and method for making artistic designs into any haired surface of an individual. When used, the device 10 allows both novice and expert hair stylists and hygienists to form intricate designs into the haired surface on individuals undergoing hair trimming or removal. Further, when used as a kit form, or with multiple assembled devices of different design, the device 10 allows the customer to choose the desired design for the stylist to impart to their body and to be confident that the result will look just like the design head or heads chosen.

The device 10 as herein disclosed in its various preferred embodiments provides for the accurate placement of an infinite number of designs in the hair 12 on the body of the person 13 being groomed with a haircut or hair removal from the head, pubic area, or from some other portion of the anatomy. In use the device 10 in the simplest preferred embodiment has a design head 14 with an exterior perimeter 15 which provides the stylist or hygienist a guide with which to form highly accurate and repeatable design on a haired surface of the body.

The potential number of different designs achievable by appropriately shaped exterior perimeters 15 of the design heads 14 are infinite. Such designs could include star 14*a* or heart 14*b* or flower 14*c* or any of an infinite number of different designs which may be formed on the head, pubic area, or on any other hairy area on the skin of the client or fur of an animal.

The number of different designs is only limited by the imagination. Because the perimeter edge 15 of the design head 14 determines the ultimate design formed on a haired surface, any such design placed in the haired surface can be easily duplicated or repeated. Or, for variety, one design can be accompanied by another design through the simple engagement of a differently shaped design head 14 to be shaved around by a means for hair cutting such as clippers 16.

In a currently preferred embodiment, the design heads 14 formed with exterior perimeters 15 having the desired shapes are permanently engaged to the end of a support shaft 18 such that the user may grip the support shaft at a distal end 20 and place the design head 14 engaged on the opposite end upon the haired surface of a body being shaved or trimmed.

In another preferred embodiment of the device 10 would employ means for removable engagement of the design head 14 to the distal end of the support shaft 18. Using removable means for engagement would allow the device to be available in a kit form. The kit would feature a plurality of differently shaped design heads 14 all engageable with the support shaft 18. Using a means to removably engage any of the provided design heads 14 individually to an attachment end 22 on the support shaft 18, any number of shapes and sizes of the design heads 14 may be employed and easily attached or removed from the support shaft 18. The user would simply choose the design head 14 of a desired shape from a kit of design heads 14 of different shapes, and removably attach it to the support shaft 18. Changing the design head 14 is just as easy by simply removing the attached design head 14 of one shape and engaging another design head 14 of a different shape. Since all the design heads 14 use the similar means for removable engagement to the support shaft 18, all are easily mounted and removed as needed.

A means for removable attachment of the design head 14 to the support shaft 18 is shown in a current preferred mode as a collar 24 having an aperture 26 which would engage with a biased projection 28 on the attachment end 30 of the support shaft 18. Of course those skilled in the art will realize that any number of means of attachment of the design head 14 to the support shaft 18 could be used and such are anticipated.

Figure 1:
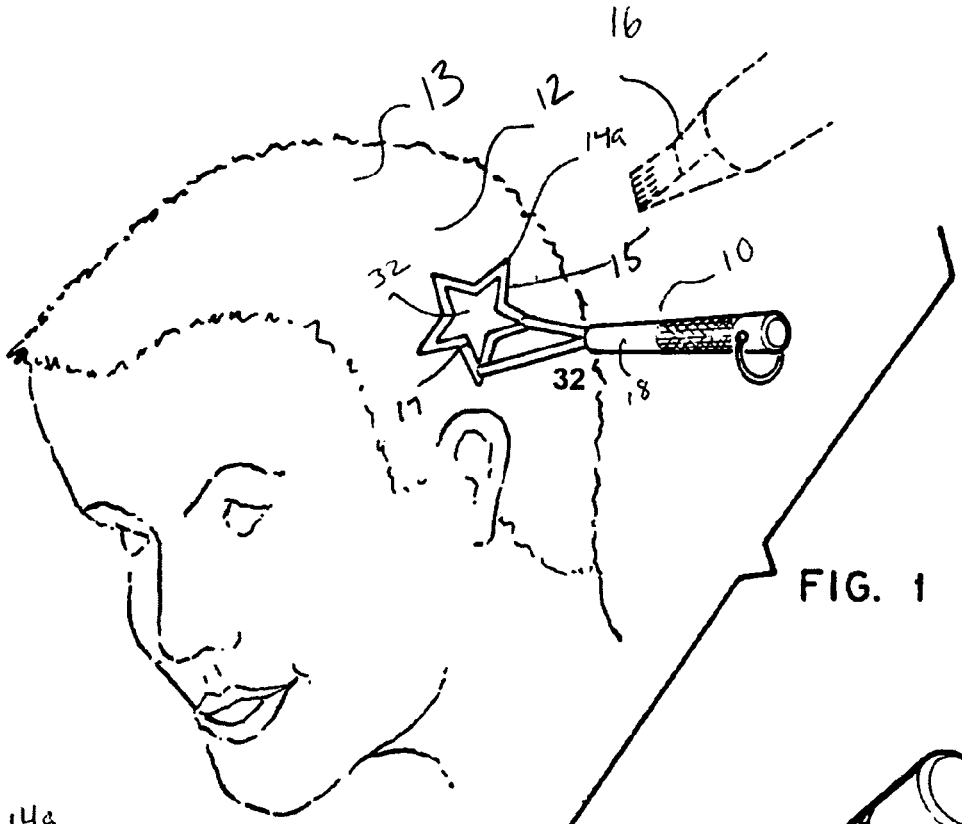
FIG. 1 is a perspective view showing the design head of the device communicating with a haired surface on an individual and the clipper or other cutting means that would be used to form the design in the haired surface.
Figure 3:
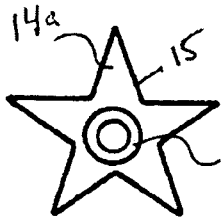
FIG. 3 is a top view of another design head shape in the form of a star and showing a collar used to engage upon the support shaft.
Figure 2:
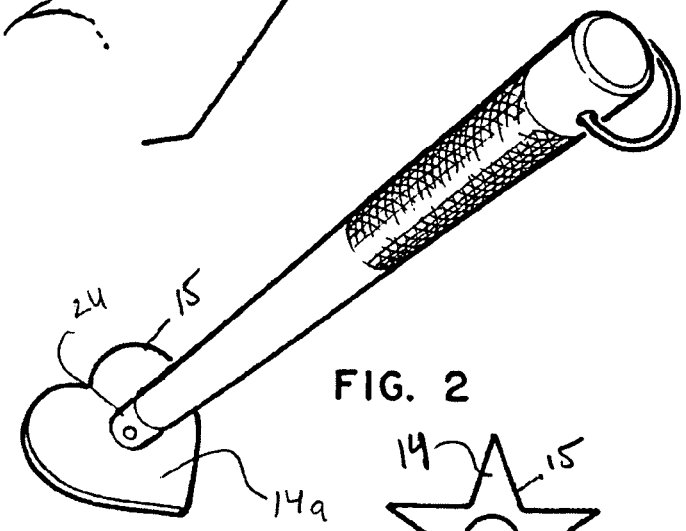
FIG. 2 is a perspective view of another preferred embodiment of the disclosed device having a gripping area on the distal end of a support shaft and a design head in the shape of a heart engaged on the opposite end.

In an additionally preferred embodiment of the device 10 as depicted in FIG. 1, the design head 14 shaped to guide the formation of the same shape in the haired surface of the individual may be positive in nature where they are outlined with clippers 16 to leave longer hair in the shape of the design head 14. Or, the design head 14 can have an interior perimeter edge 17 defining an interior aperture 32 formed by the interior perimeter 17. This embodiment would be either permanently or removably engaged to the support shaft 18 and can be used to either trim around the perimeter to leave longer hair where the design head 14 is placed on the haired surface, or, to trim in the hollow interior aperture 32 to leave a negative impression in surrounding haired areas. This embodiment allows either a positive or negative design to be formed or it could be used to trim along both perimeters and leave a small design of growing hair. Should a dual design be desirable, the interior perimeter 17 can be of a different shape than the exterior perimeter 15 such as in FIG. 3*a* where a circle may be formed inside of the star. This embodiment would provide for multiple shapes in the hair designs formed as desired. When the interior perimeter 17 and the interior aperture 32 cover the center area of the design head 14, the engagement to the support shaft 18 would be off center and possibly along an edge such as in FIG. 1, and just as in the other embodiments noted, can be removably or permanently engaged depending on the versatility desired.

In use as a method to form a design in a haired or furry surface, the user would choose the desired shaped design head 14 and engage it on a haired surface by pushing slightly on the support shaft 18. Then the haired surface would be trimmed around the exterior perimeter 15 for a positive design leaving hair inside the exterior perimeter 15. Alternatively, hair can be trimmed from inside the interior perimeter 17 to leave a negative design in the surrounding hair. Or in another step, a design head 14 where the exterior perimeter 15 differs in shape from the interior perimeter 17 can be employed and the hair cut around both perimeters to leave a different design shape formed inside the shape of the exterior perimeter 15.

As shown in the various embodiments, the support shaft 18 should extend from its engagement to the planar surface of the design head 14 at an obtuse angle. This allows the user to easily compress the design head 14 on the haired surface being trimmed and use the clippers around the exterior perimeter 15 or interior perimeter 17 without having to change hands or to move the design head 14 from its compressed engagement rendering the device 10 much easier to use.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

Further, the purpose of the attached abstract is to enable the U.S. Patent and Trademark Office and the public generally and especially the scientists, engineers and practitioners in the art who are not familiar with patent or legal terms or phraseology to determine quickly from a cursory inspection the nature and essence of the technical disclosure of the application. The abstract is neither intended to define the invention of the application which is measured by the claims, nor is it intended to be limiting as to the scope of the invention in any way.

What is claimed is:

1. An apparatus for forming designs in a haired surface on a body comprising:

a design head having a planar body said body having a first shape defined by an exterior perimeter edge;

a support shaft;

a collar engaged upon said design head having an axial cavity;

said axial cavity dimensioned for engagement upon said support shaft;

means for releasable engagement of said collar to said support shaft thereby providing means for removable engagement of said support shaft to said design head; and said design head compressibly engageable upon a haired surface of a body by pressuring said support shaft; and said exterior perimeter edge providing a first design shape formable in said haired surface when said haired surface is trimmed around said exterior perimeter.

2. The apparatus for forming designs in a haired surface of claim 1 additionally comprising:

said planar body having an aperture formed inside said exterior perimeter edge, said aperture having an aperture shape defined by an interior perimeter edge; and said exterior perimeter edge defining a second design shape formable in said haired surface by trimming said haired surface.

3. The Apparatus for forming designs in a haired surface of claim 2 additionally comprising:

said design head being one of kit of design heads; each of said kit of design heads having a different said exterior perimeter edge shape defining a different first design head shape; and said aperture having a shape defined by said interior perimeter edge which is substantially similar to said exterior perimeter edge shape; and each of said design heads of said kit of design heads being removably engageable to said support shaft.

4. The Apparatus for forming designs in a haired surface of claim 2 additionally comprising:

said support shaft extending from said design head at a substantially obtuse angle.

5. The Apparatus for forming designs in a haired surface of claim 1 additionally comprising:

said design head being one of kit of design heads; each of said kit of design heads having a different exterior perimeter edge shape defining a different first design shape; and each design head of said kit of design heads being removably engageable to said support shaft.

6. The Apparatus for forming designs in a haired surface of claim 1 additionally comprising:

said support shaft extending from said design head at a substantially obtuse angle.

7. A method of forming designs in the haired surface on a body employing a design head having a perimeter edge defining a first shape, said design head being removably attachable to a support shaft by a releasable engagement of said support shaft in a slidable engagement within an axial cavity defined by a collar extending from said design head, comprising the steps of:

engaging said design head upon said support shaft by sliding said support shaft in said axial cavity;

grasping the support shaft and compressing the surface of the design head on a haired surface of a body; and employing a means to trim hair to trim the hair adjacent to said perimeter edge to thereby form said first shape in said haired surface.

8. A method of forming designs in the haired surface on a body employing a design head having an exterior perimeter edge defining a first shape and having an aperture inside said perimeter edge having a second shape defined by an interior perimeter edge, said design head being removably attachable to a support shaft by a releasable engagement of said support shaft in a slidable engagement within an axial cavity defined by a collar extending from said design head, comprising the steps of:

engaging said design head upon said support shaft by sliding said support shaft in said axial cavity;

grasping the support shaft and compressing the surface of the design head on a haired surface of a body; and employing a means to trim hair to trim haired surface at either one or both of an area adjacent to said exterior perimeter edge and the area inside said aperture, to thereby form one or both of said first shape and said second shape in said haired surface.

* * * * *